US011459210B2

(12) United States Patent
Fauconnet et al.

(10) Patent No.: US 11,459,210 B2
(45) Date of Patent: Oct. 4, 2022

(54) ELEVATOR CAR WITH WORKING PLATFORM STABILIZATION

(71) Applicant: Otis Elevator Company, Farmington, CT (US)

(72) Inventors: Aurelien Fauconnet, Isdes (FR); Pascal Rebillard, Gien (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 20 days.

(21) Appl. No.: 16/919,691

(22) Filed: Jul. 2, 2020

(65) Prior Publication Data

US 2021/0002104 A1 Jan. 7, 2021

(30) Foreign Application Priority Data

Jul. 5, 2019 (EP) ..... 19305917

(51) Int. Cl.
*B66B 11/02* (2006.01)
*B66B 5/00* (2006.01)

(52) U.S. Cl.
CPC ..... *B66B 11/0246* (2013.01); *B66B 5/0087* (2013.01)

(58) Field of Classification Search
CPC ..... B66B 11/0246; B66B 5/0087
See application file for complete search history.

(56) References Cited

U.S. PATENT DOCUMENTS 6,202,800 B1 * 3/2001 Muller ..... B66B 11/0246 187/401
6,202,801 B1 * 3/2001 Muller ..... B66B 11/0246 187/269
6,419,052 B1 * 7/2002 Muller ..... B66B 11/0246 187/414
6,691,833 B1 * 2/2004 Elsener ..... B66B 5/288 187/266
6,880,678 B1 * 4/2005 Schneider ..... B66B 11/0246 187/314

(Continued)

FOREIGN PATENT DOCUMENTS

WO 2018104578 A1 6/2018

OTHER PUBLICATIONS

European Search Report for application EP 19305917.7 , dated Feb. 11, 2020, 56 pages.

*Primary Examiner* — Michael A Riegelman
(74) *Attorney, Agent, or Firm* — Cantor Colburn LLP

(57) ABSTRACT

An elevator car comprises one or more side walls (4*a*) defining an interior space for accommodating passengers and/or cargo, and a support frame positioned above the interior space. A working platform (12) is suspendably connected to the support frame and moveable between a stowed position, above the interior space, and an operational position, suspended within the interior space. The working platform (12) comprises at least one stabilizing member (14) and the at least one stabilizing member (14) comprises a first engagement portion (22). At least one side wall (4*a*) comprises a second engagement portion (6) such as a handrail. When the working platform (12) is in the operational position, the first engagement portion (22) is configured to engage with the second engagement portion (6) so as to stabilize the working platform (12) in the operational position.

11 Claims, 5 Drawing Sheets

(56) References Cited

U.S. PATENT DOCUMENTS

| | | | | |
|---|---|---|---|---|
| 7,337,880 | B2 * | 3/2008 | Sittler | B66B 11/0246 187/401 |
| 9,193,566 | B1 * | 11/2015 | Nieves | B66B 11/0226 |
| 9,546,078 | B2 * | 1/2017 | Paasisalo | B66B 11/0226 |
| 11,091,352 | B2 * | 8/2021 | Fauconnet | B66B 11/0206 |
| 11,104,550 | B2 * | 8/2021 | Fernandez | B66B 11/0246 |
| 2006/0289244 | A1 * | 12/2006 | Sittler | B66B 11/0246 187/401 |
| 2007/0056809 | A1 * | 3/2007 | Fernandes | B66B 11/0246 187/401 |
| 2007/0056810 | A1 * | 3/2007 | Fernandes | B66B 5/00 187/401 |
| 2019/0226217 | A1 * | 7/2019 | Foley | E04G 1/34 |
| 2019/0330023 | A1 * | 10/2019 | Fauconnet | B66B 11/0246 |
| 2020/0277163 | A1 * | 9/2020 | Fauconnet | B66B 5/005 |
| 2020/0277164 | A1 * | 9/2020 | Fauconnet | B66B 19/00 |
| 2021/0002104 | A1 * | 1/2021 | Fauconnet | B66B 5/0087 |
| 2021/0269279 | A1 * | 9/2021 | Talonen | B66B 11/0246 |
| 2021/0269283 | A1 * | 9/2021 | Siironen | B66B 11/0246 |

* cited by examiner

ELEVATOR CAR WITH WORKING PLATFORM STABILIZATION

FOREIGN PRIORITY

This application claims priority to European Patent Application No. 19305917.7, filed Jul. 5, 2019, and all the benefits accruing therefrom under 35 U.S.C. § 119, the contents of which in its entirety are herein incorporated by reference.

TECHNICAL FIELD

This disclosure relates to an elevator car with a working platform used to carry out maintenance from inside an elevator car.

BACKGROUND

It is known to provide working platforms located in or above the ceiling of elevator cars, which are moveable between a stowed position and a deployed position. In the deployed position, the working platform is located within the car, at such a height that a maintenance person is able to stand on the working platform and access elevator components through an opening in the elevator car ceiling. It is desirable to provide such a working platform with stabilization.

SUMMARY

According to a first aspect of this disclosure, there is provided an elevator car comprising one or more side walls defining an interior space for accommodating passengers and/or cargo, the elevator car comprising: a support frame positioned above the interior space; a working platform suspendably connected to the support frame and moveable between a stowed position, above the interior space, and an operational position, suspended within the interior space; wherein the working platform comprises at least one stabilizing member and the at least one stabilizing member comprises a first engagement portion; wherein at least one side wall of the one or more side walls comprises a second engagement portion; and wherein, when the working platform is in the operational position, the first engagement portion is configured to engage with the second engagement portion so as to stabilize the working platform in the operational position.

By providing at least one stabilizing member comprising an engagement portion which can be engaged with another engagement portion that is part of a side wall of the elevator car, when the working platform is in the operational position, the lateral stability of the working platform can be improved significantly. Lateral stability is a serious problem for working platforms which are deployed from above the ceiling of an elevator car, since it is necessary that such working platforms be smaller than the cross-sectional size of the car, such that they can be deployed easily and without damaging the side walls of the elevator car. As a result, when a working platform is suspended within the interior space in the operational position, in the absence of stabilization as described herein, the working platform is not touching any surface within the elevator car, and is therefore subject to sway or tilt in one or more lateral directions. Using a side wall of the elevator care to provide stabilization for the working platform, as disclosed herein, provides this lateral stability in a reliable way, thus resulting in a working platform which is both safer and easier for a maintenance person to use.

The working platform is suspendably connected to the support frame and hangs down from the support frame when the working platform is in the operational position e.g. the working platform is hanging in a generally horizontal plane so that a maintenance person can stand on the working platform. The support frame is able to withstand the weight of the working platform and any load carried by the working platform during use. However, generally such support frames are not capable of or effective at preventing movements of the working platform in a horizontal plane (i.e. in lateral directions) when the working platform is suspended in the operational position. Thus the working platform may be prone to sway from side to side. In the present disclosure, it is to be understood that the working platform is stabilized in the operational position by providing lateral stability, which includes the prevention or restriction of motion of the working platform in an approximately horizontal plane.

According to a second aspect of this disclosure, there is provided a method of stabilizing a working platform in an elevator car, wherein the elevator car comprises one or more side walls defining an interior space for accommodating passengers and/or cargo, and wherein the working platform is suspendably connected to a support frame positioned above the interior space, the method comprising: moving the working platform from a stowed position, above the interior space, to an operational position, suspended within the interior space; and deploying at least one stabilizing member, which comprises a first engagement portion, to engage the first engagement portion with a second engagement portion of a side wall of the elevator car.

It will be appreciated that the second engagement portion functions to provide a positive engagement with the first engagement portion (i.e. the engagement portion of the at least one stabilizing member). Rather than the at least one stabilizing member simply pressing against the surface of a side wall, there is a physically distinct engagement portion positioned on the at least one side wall. In one or more examples, the second engagement portion may be a protrusion from the at least one side wall. In one or more examples, the second engagement portion may be recess in the at least one side wall. The second engagement portion may have a shape that is exploited to give a good degree of engagement with the at least one stabilizing member.

In some examples, the second engagement portion is a handrail of the elevator car. This advantageously allows the at least one stabilizing member to engage with a structure which is already present within an elevator car, as standard, and therefore provides lateral stability to the working platform whilst requiring minimal additional components. The inventors have realised that, in many elevator cars, the existing handrails are at, or approximately at, a desirable height for the operational position of the working platform. This would allow one or more stabilizing members to be retroactively fitted to working platforms, in elevator cars in which a handrail is close to the desired height of the operational position of a suspended working platform.

In some examples, in addition or alternatively, the second engagement portion is at a predetermined height within the elevator car. This allows the second engagement portion to be positioned at an appropriate height for the specific height of the working platform in the operational position. Preferably, the height of the second engagement portion is chosen such that the at least one stabilizing member of the working platform is adjacent to the second engagement portion when the working platform is in the operational position. Optionally, the height of the second engagement portion is configured such that a maintenance person standing on the working platform, in the operational position, protrudes approximately 0.5-1.0 m out of an opening at the top of the interior space of the elevator car. Preferably, the height of the second engagement portion is between 1-1.5 m vertically above a car floor. Preferably, the second engagement portion is at least 1.1 m vertically below the support frame. This ensures that the working platform is stabilized in an operational position that allows a safety balustrade of a minimum height of 1.1 m to be mounted on the working platform when in use.

In the operational position, the working platform is suspended from the support frame to hang within the interior space. The weight of the working platform is therefore supported by the support frame. The height in the elevator car at which the working platform is suspended may be determined by a connection mechanism arranged to suspendably connect the working platform to the support frame. The inventors have realised that it may be convenient for the connection mechanism to set the operational position so that the working platform is suspended at a height corresponding to a handrail or other second engagement portion. Most conveniently, the working platform may have a single operational position. This means that an engineer does not need to spend time lowering the working platform into alignment with a handrail or other second engagement portion, as the single operational position may be achieved automatically by the connection mechanism. Thus, according to one or more examples, the car comprises a connection mechanism arranged to suspendably connect the working platform to the support frame, wherein the connection mechanism extends to suspend the working platform at a single operational position wherein the first engagement portion is at the same predetermined height within the elevator car as the second engagement portion. For example, the connection mechanism may comprise a scissor mechanism.

In at least some examples, in addition or alternatively, the at least one stabilizing member is a first stabilizing member and the working platform further comprises a second stabilizing member, and wherein the first stabilizing member and the second stabilizing member are positioned at opposed sides of the working platform. This advantageously provides increased lateral stability by securing both sides of the working platform. The first and second stabilizing members may each engage with the same second engagement portion (such as a handrail on one side wall), or the first and second stabilizing members may each engage with a different second engagement portion (such as the handrails on opposed side walls).

In at least some examples, the working platform comprises four stabilizing members. The working platform can then be stabilized against tilting in two directions. Optionally two of the stabilizing members are positioned at a first side of the working platform, e.g. adjacent to the same second engagement portion (such as a handrail on one side wall), and the other two of the stabilizing members are positioned at a second side of the working platform, e.g. adjacent to another second engagement portion (such as a handrail on another opposed side wall). In these or other examples, more than one stabilizing member engages with each second engagement portion (such as a handrail).

In at least some examples, in addition or alternatively, the first engagement portion comprises a hook. This advantageously provides a simple structure which can be easily engaged with the second engagement portion. In the examples which comprise a method, the method may further comprise hooking the hook on to the second engagement portion. In the examples in which the second engagement portion is the handrail of the elevator car, the method may further comprise hooking the hook on to the handrail.

Optionally, the hook is shaped to match a shape of the second engagement portion. This advantageously provides improved engagement between the hook and the second engagement portion, due to the close fit between them.

In at least some examples, in addition or alternatively, the first engagement portion is made of a plastics material or covered with a plastics material. It will be understood that a plastics material means any artificial or natural polymer material, which includes plastic and rubber materials. Preferably the plastics material is a soft material e.g. thermoplastic or elastomer. The plastics material may be chosen so as to ensure that the first engagement portion is non-damaging to the interior surfaces of the elevator car. This prevents damage from occurring to the second engagement portion (such as a handrail), which could leave unsightly marks in the elevator car which would be visible to passengers. In some examples, the at least one stabilizing member is made of a plastics material or covered with a plastics material. This can also provide for ease of manufacture, for example by injection moulding the at least one stabilizing member in a suitable shape.

In at least some examples, in addition or alternatively, the at least one stabilizing member is movable between a retracted position and a deployed position and, in the deployed position, the first engagement portion is configured to engage with the second engagement portion. This advantageously allows the at least one stabilizing member to be moved to a more convenient position when it is not in use, i.e. when the platform is in the stowed position, and to be moved out only when it is to be used.

In some examples, in the retracted position, the at least one stabilizing member is entirely within the vertical footprint of the working platform and wherein, in the deployed position, the at least one stabilizing member extends laterally outside of the vertical footprint of the working platform. This is advantageous, since, as explained above, an elevator working platform generally has a cross-sectional area which is smaller than the cross-section of the interior space of the elevator car, so as to move easily within the interior space, often moving approximately vertically up and down between the stowed and operational position, and also so as not to damage the interior surfaces of the elevator car. Having the retracted position of the at least one stabilizing member be within the footprint of the working platform advantageously allows the working platform to offer the benefits laid out above, by not extending the footprint of the working platform, whilst additionally providing the benefits of the at least one stabilizing member as disclosed herein.

In some examples, the at least one stabilizing member is lockable in the retracted position. This advantageously ensures that the at least one stabilizing member stays in the desired retracted position as the platform is moved by a maintenance person, thus ensuring that the at least one stabilizing member does not get in the way or interfere with their moving of the platform. In some examples, additionally, or alternatively, the at least one stabilizing member is lockable in the deployed position. This advantageously provides further stability to the working platform, and provides increased safety to a maintenance person who is using the platform, by ensuring that the lateral stability continues to be provided to the working platform as it is used.

In some examples, the at least one stabilizing member comprises a first projection; the working platform comprises a slot; and the first projection is configured to slide in the slot, as the at least one stabilizing member is moved between the retracted position and the deployed position. This advantageously allows easy movement of the at least one stabilizing member between a retracted position and a deployed position, with the use of minimal additional components.

Optionally, the slot further comprises an inner recess and an outer recess, and the first projection is arranged to be received in the inner recess when the stabilizing member is in the retracted position. This advantageously allows the stabilizing member to be locked into the retracted position in a simple and easy manner, using the projection, which is already present to allow movement of the stabilizing member.

Optionally, in addition or alternatively, the slot further comprises an inner recess and an outer recess and the first projection is arranged to be received in the outer recess when the stabilizing member is in the deployed position. This advantageously allows the stabilizing member to be locked into the deployed position in a simple and easy manner, using the projection, which is already present to allow movement of the stabilizing member.

In at least some examples, in addition or alternatively, the elevator car further comprises a cover panel, which is configured to cover the working platform when the working platform is in the stowed position. This advantageously allows the working platform, when in the stowed position, to be covered neatly and therefore hidden from the view of any passengers who might use the elevator car, improving the experience of the passengers. The cover panel may, for example, comprise a decorative ceiling cover panel. In one or more examples, the cover panel may be pivotably attached to the support frame. In such examples, the cover panel may pivot relative to the support frame to cover the working platform when the working platform is in the stowed position.

There is also disclosed an elevator system comprising an elevator car according to any of the examples disclosed herein.

DRAWING DESCRIPTION

Certain preferred examples of this disclosure will now be described, by way of example only, and with reference to the accompanying drawings, in which:

FIGS. 1*a*, 1*b* and 1*c* are cutaway schematic views of an elevator car including a working platform, moveable between a stowed position (as shown in FIGS. 1*a* and 1*b*) and an operational position (as shown in FIG. 1*c*);

FIGS. 2*a*, 2*b* and 2*c* show schematically a side view of part of a working platform next to a side wall of the elevator car;

FIG. 3*a* is a three-dimensional view of an exemplary stabilizing member according to the present disclosure;

FIG. 3*b* shows a side profile of the stabilizing member of FIG. 3*a;*

DETAILED DESCRIPTION

Figure 1C:
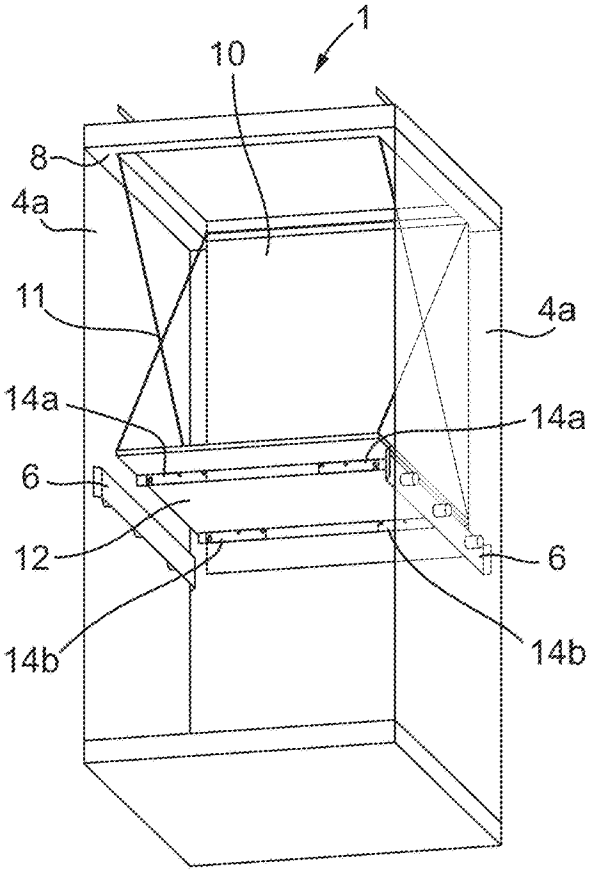
Figure 1B:
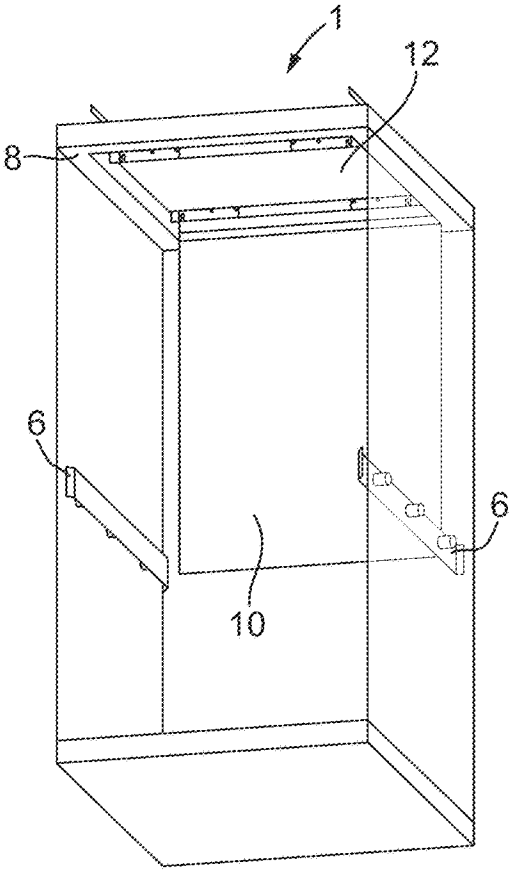
Figure 1A:
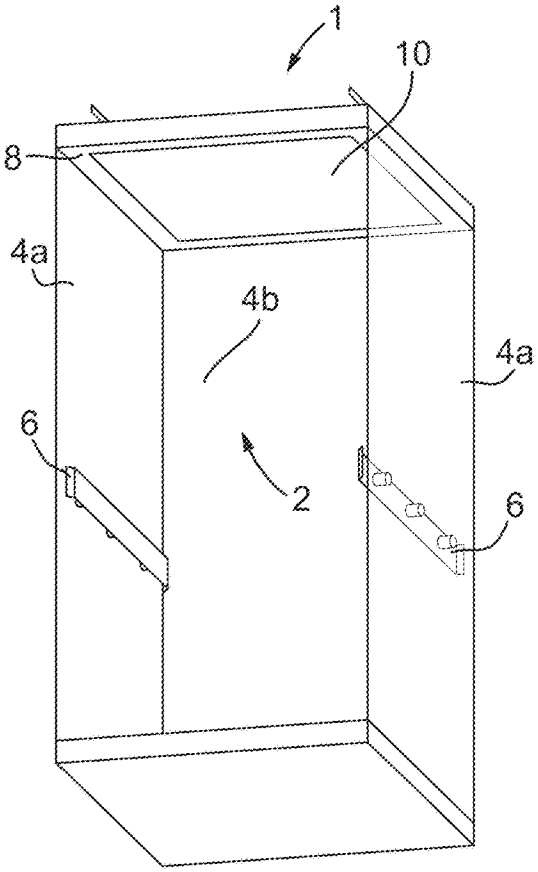

FIG. 1*a* shows a view of an elevator car 1, comprising side walls 4*a*, 4*b* which define an interior space 2. The elevator car 1 has two opposed side walls 4*a* to which handrails 6 are attached. The elevator car 1 additionally has two opposed side walls 4*b* (only one of which is visible in this figure), on which there are no handrails. Above the interior space 2 there is positioned a support frame 8, beneath which there is pivotably attached a decorative ceiling cover panel 10. In this arrangement, as shown in FIG. 1*a*, a passenger located within the interior space 2 of the elevator car 1, sees the decorative ceiling cover panel 10 as covering the vast majority, or even the entirety of the elevator car ceiling, such that the support frame 8 is not normally visible.

FIG. 1*b* shows the elevator car 1 of FIG. 1*a*, in which the decorative ceiling cover panel 10 has been pivoted down to an open position. The elements of FIG. 1*b*, which are already labelled in FIG. 1*a*, and could easily be identified as like elements by the skilled person, have not been labelled again in FIGS. 1*b* and 1*c* so as to improve the clarity of the drawings. FIG. 1*b* shows the decorative ceiling cover panel 10 as having been hinged open, from a pivot point in the elevator car ceiling, although it is equally possible that the decorative ceiling cover panel 10 could be fixed in place by any other suitable mechanism, such as for example screws or clips, and could then be removed entirely from the ceiling of the elevator car in order to expose the support frame 8.

Once the cover panel 10 has been pivoted down or removed, the working platform 12 is then visible, located within the support frame 8 above the interior space 2 of the elevator car 1. In the elevator car 1 as shown in FIG. 1*b*, the working platform 12 is still in the stowed positon, but is now accessible such that a maintenance person can move the working platform 12 from the stowed position shown in FIG. 1*b*, to the operational position, as shown in FIG. 1*c*. As is most clearly seen in FIG. 1*c*, a connection mechanism 11 is arranged to suspendably connect the working platform 12 to the support frame 8. In this example, the connection mechanism 11 is a scissor mechanism. The scissor mechanism 11 opens out to allow the working platform 12 to drop down to a predetermined height in the elevator car 1 which is at substantially the same height as the handrails 6. The connection mechanism 11 can be any suitable mechanism which allows the working platform 12 to be moved between the stowed position and the operational position, and adequately supports the working platform 12 (together with any load carried in use) in its operational position.

As shown in FIG. 1*c*, the working platform 12 can be lowered from the stowed position into the interior space 2 of the elevator car 1. This lowered position of the working platform 12 is referred to herein as the operational position. It is in this operational position that a maintenance person can use the working platform 12 to stand on, and thereby access parts of the elevator system through the open ceiling for maintenance purposes. In particular, the height of the working platform 12 in the operational position is ideally at least 1.1 m below the support frame 8, such that a maintenance person standing fully upright on the working platform 12 will protrude out of an opening in the ceiling of the elevator car 1 as provided by the support frame 8. Furthermore, this means that the maintenance person has enough room below the support frame 8 to erect a safety balustrade on the working platform 12, the height of the safety balustrade being at least 1.1 m according to the European Standard EN81-1.

As best seen in FIG. 1*c*, the working platform 12 includes at least one stabilizing member 14, and in this example there are four stabilizing members 14, a first stabilizing member 14*a* and a second stabilizing member 14*b* positioned at opposed sides of the working platform 12 on the left hand side of the car 1, and a first stabilizing member 14*a* and a second stabilizing member 14*b* positioned at opposed sides of the working platform 12 on the right hand side of the car 1. Each of the stabilizing members 14*a*, 14*b* can be engaged with a second engagement portion 6 on the adjacent side wall 4*a* of the elevator car 1 in order to provide lateral stability to the working platform 12. In this example, the handrails 6 on the left and right hand sides of the car 1 act as the second engagement portion. This is advantageous since the handrail 6 is a structure already existing on the side walls 4*a* of the elevator car 1, and hence provides the second engagement portion without requiring the addition of any further components to the elevator car 1. However, any other suitable structure on or in the side wall(s) 4*a* of the elevator car 1 may be used as a second engagement portion according to the present disclosure. For example, there may be a protrusion from or recess in the side wall(s) 4*a* that acts as a second engagement portion.

Figure 2A:
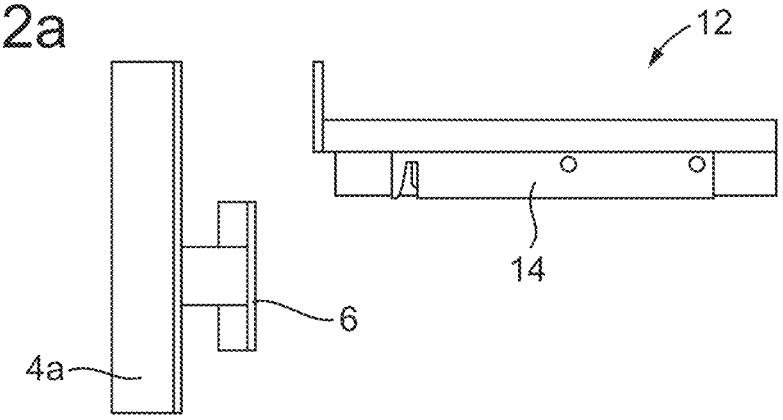
Figure 2B:
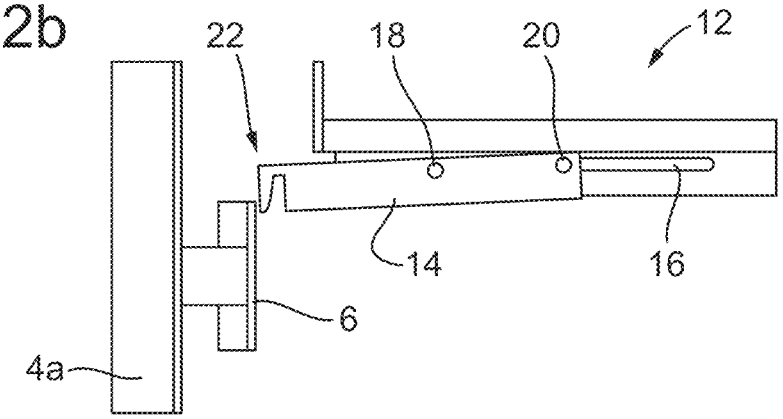
Figure 2C:
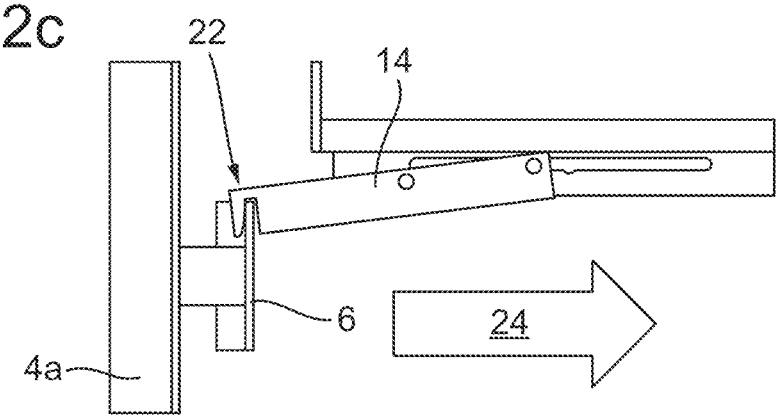

An exemplary stabilizing member 14 adjacent to a handrail 6 is shown in more detail in FIGS. 2*a*, 2*b* and 2*c*, which show a horizontal side view of the stages of the engagement process as the stabilizing member 14 is deployed to engage with the hand rail 6 on a side wall 4*a*.

In FIG. 2*a*, the stabilizing member 14 is shown in a retracted position. In this position, the stabilizing member 14 is entirely within the vertical footprint of the working platform 12. The vertical footprint will be understood by the skilled person as the vertical cross section of the working platform 12, extended both upwards and downwards in the vertical direction of the elevator car.

In use, a maintenance person will first move the working platform 12 from the stowed position to the operational position, as shown in FIGS. 1*a* to 1*c*. With the working platform 12 in the operational position, a maintenance person can then move the stabilizing member 14 out of the retracted position (FIG. 2*a*), in a direction towards the handrail 6. In the example as shown, the working platform 12 comprises a slot 16, and the stabilizing member 14 comprises a first projection 18 and a second projection 20, which are sized such that they can slide within the slot 16. In order to move the stabilizing member 14, a maintenance person slides the stabilizing member 14 towards the handrail 6, as seen in FIG. 2*b*, causing the first and second projections 18, 20, to slide in the slot 16.

The stabilizing member 14 comprises a first engagement portion 22, which in some examples is a hook. Once the stabilizing member 14 is slid fully into the deployed position, as shown in FIG. 2*c*, the hook 22 is shaped so that the hook 22 can be hooked over the handrail 6, and the stabilizing member 14 is thereby prevented, by the hook 22, from moving away from the handrail 6 in the lateral direction, shown by arrow 24, as long as the hook 22 is engaged with the handrail 6. At least the hook 22, if not the whole stabilizing member 14, is made of a plastics material or covered with a plastics material. This helps to prevent damage to the handrail 6.

Figure 3A:
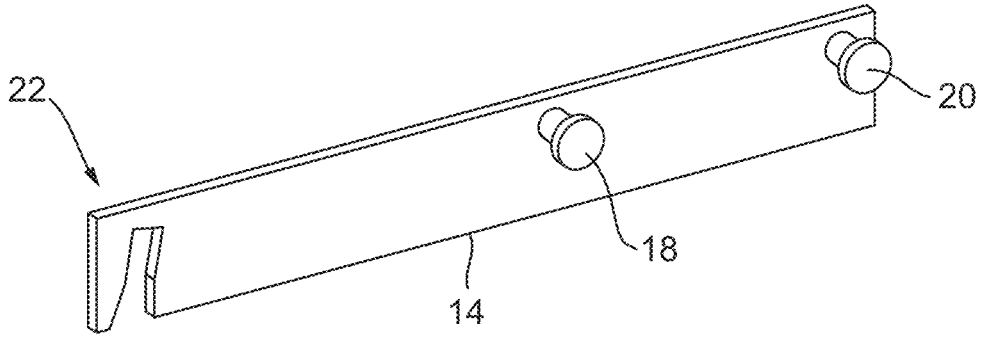
Figure 3B:
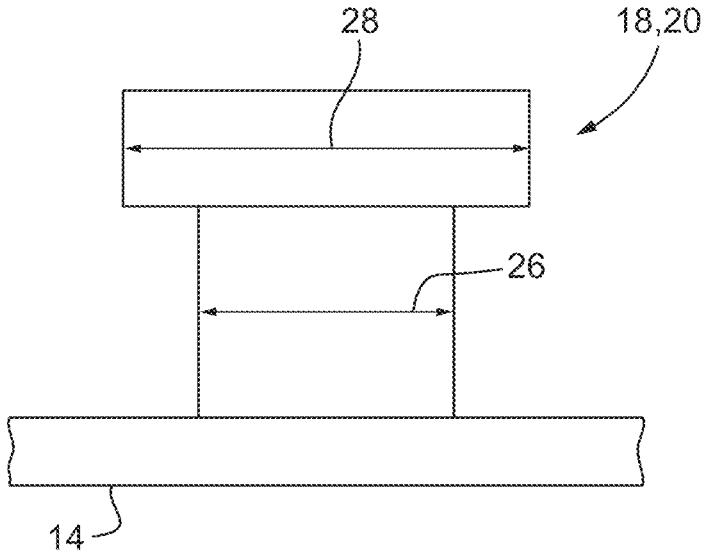

The stabilizing member 14 is shown in the three-dimensional representation of FIG. 3*a*. The first engagement portion 22 comprises a cut-out portion, forming the hook 22, which is complementary with the profile shape of the handrail 6. The first projection 18 and the second projection 20 are shown in FIG. 3*a*, and a profile, which could be the profile of either the first projection 18 or the second projection 20, or both, is shown in FIG. 3*b*. Each projection 18,20 is shaped to have a circular cross-section and comprises an inner portion of a first diameter 26 and an outer portion of a second diameter 28, wherein the second diameter is larger than the first diameter. This is advantageous because the first, smaller, diameter 26 may be sized to be smaller than the width 40 of the slot (shown in FIG. 4), which allows the projections to slide easily within the slot 16 of the working platform 12. The second diameter 28 may be larger than the width 40 of the slot 16 (seen in FIG. 4), so that the first and second projections 18, 20, are held within the slot 16, due to the larger diameter 28 on one side and the stabilizing member 14 on the other, neither of which can pass through the slot 16.

Figure 4:
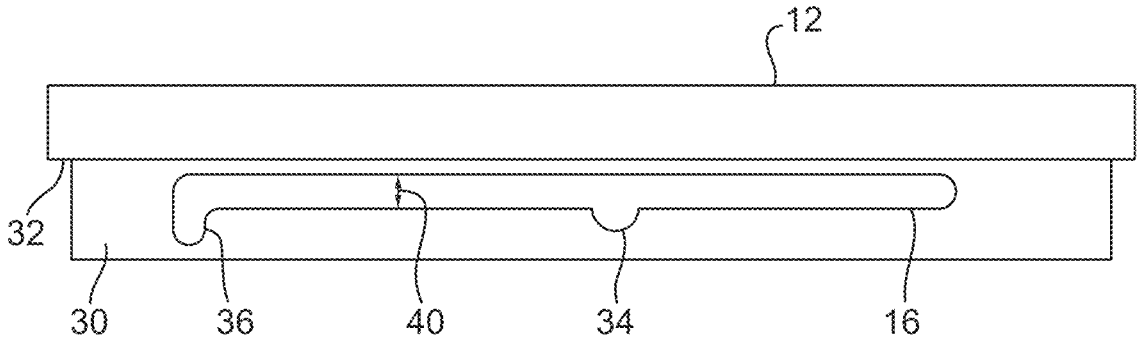
FIG. 4 shows schematically a side view of a working platform according to an example of the present disclosure.

FIG. 4 shows schematically a side view of the slot 16 of the working platform 12. In this example, the working platform 12 comprises a rail 30, attached to a bottom surface 32 of the working platform 12. The bottom surface 32 will be understood by the skilled person to be the surface of the working platform 12 closer to the floor of the elevator car 1, at least when the working platform 12 is in the operational position. The slot 16 is formed in the rail 30. The slot 16 is formed, as shown, with an inner recess 34, which is located towards the end of the slot 16 which is closer to the centre of the working platform 12, and an outer recess 36, formed at the end of the slot 16 closer to the outside of the working platform 12 i.e. closer to the handrail 6. The inner recess 34 and the first projection 18 are arranged so that the first projection 18 is received in the inner recess 34, when the stabilizing member 14 is in the retracted position, thus retaining the stabilizing member 14 in the retracted position. The outer recess 36 is arranged such that when the hook 22 is engaged with the handrail 6, the first projection 18 is received within the outer recess 36, thereby retaining the stabilizing member 14 in the deployed position. The second projection 20 is arranged to slide within the slot 16, providing greater stability to the movement of the stabilizing member 14.

Figure 5:
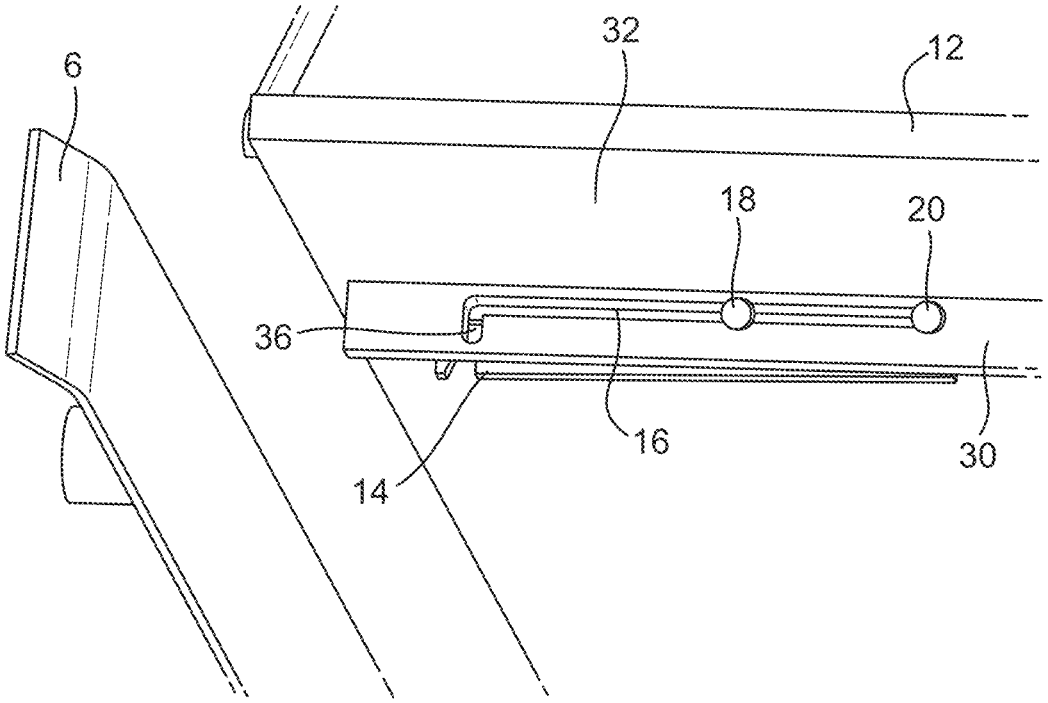
FIG. 5 is a partial three-dimensional side view of the working platform seen in FIG. 2*a*, with a stabilization member in the retracted position.

FIG. 5 shows a three-dimensional view of the underneath of the working platform 12. The stabilizing member 14 is shown in the retracted position, as is also shown in FIG. 1*a*. The first projection 18 is received in the inner recess 34 (not visible), which thereby locks the stabilizing member 14 in the retracted position, until sufficient force is applied to the stabilizing member 14 to move it from the retracted position. The second projection 20 is arranged to be at the inner end of the slot 16, when the stabilizing member 14 is in the retracted position.

Figure 6:
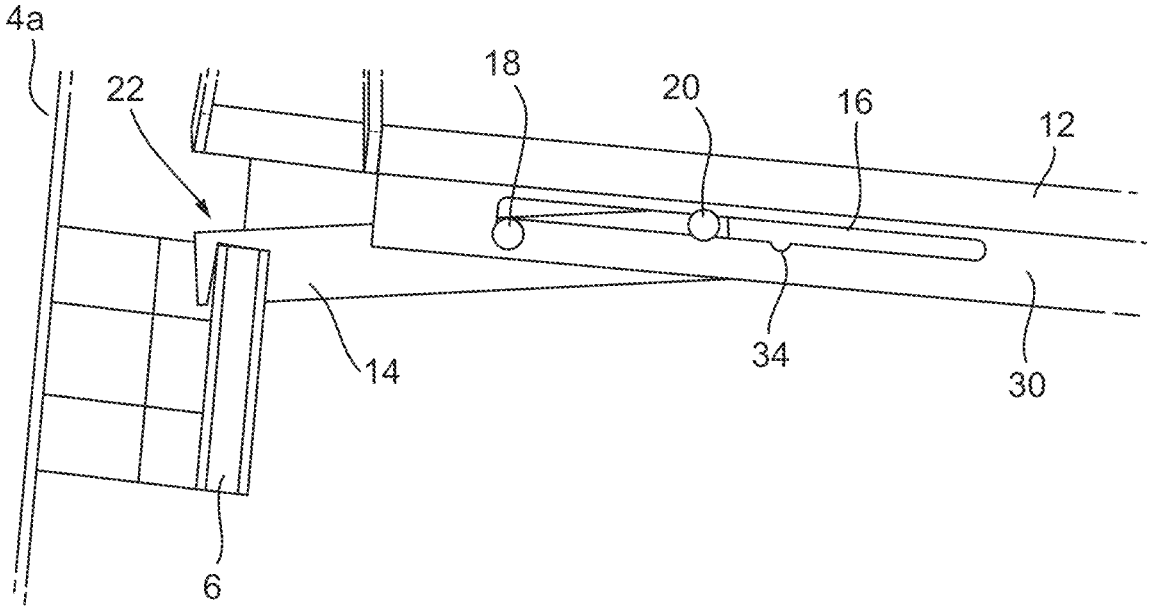
FIG. 6 is a partial three-dimensional side view of the working platform seen in FIG. 2*c*, with a stabilization member in the deployed position.

FIG. 6 shows a side view of the stabilizing member 14, in the deployed position, with the hook 22 engaged with the handrail 6. In the deployed position, the first projection 18 is received within the outer recess 36, locking the stabilizing member 14 in the deployed position.

It will be appreciated by those skilled in the art that the disclosure has been illustrated by describing one or more specific examples thereof, but is not limited to these examples; many variations and modifications are possible, within the scope of the accompanying claims.

What is claimed is:

1. An elevator car (1) comprising one or more side walls (4*a*, 4*b*) defining an interior space (2) for accommodating passengers and/or cargo, the elevator car (1) comprising:

a support frame (8) positioned above the interior space (2);

a working platform (12) suspendably connected to the support frame (8) and moveable between a stowed position, above the interior space (2), and an operational position, suspended within the interior space (2);

wherein the working platform (12) comprises at least one stabilizing member (14) and the at least one stabilizing member (14) comprises a first engagement portion (22);

wherein at least one side wall (4*a*) of the one or more side walls (4*a*, 4*b*) comprises a second engagement portion (6); and wherein, when the working platform (12) is in the operational position, the first engagement portion (22) is configured to engage with the second engagement portion (6) so as to stabilize the working platform (12) in the operational position;

wherein the at least one stabilizing member (14) is movable between a retracted position and a deployed position and wherein, in the deployed position, the first engagement portion (22) is configured to engage with the second engagement portion (6);

wherein the at least one stabilizing member (14) comprises a first projection (18); the working platform (12) comprises a slot (16); and the first projection (18) is configured to slide in the slot (16), as the at least one stabilizing member (14) is moved between the retracted position and the deployed position.

2. The elevator car of claim 1, wherein the second engagement portion (6) is a handrail of the elevator car (1).

3. The elevator car of claim 1, wherein the second engagement portion (6) is at a predetermined height within the elevator car (1).

4. The elevator car of claim 3, comprising a connection mechanism (11) arranged to suspendably connect the working platform (12) to the support frame (8), wherein the connection mechanism (11) extends to suspend the working platform (12) at a single operational position wherein the first engagement portion (22) is at the same predetermined height within the elevator car (1).

5. The elevator car of claim 1, wherein the first engagement portion (22) comprises a hook.

6. The elevator car of claim 5, wherein the hook (22) is shaped to match a shape of the second engagement portion (6).

7. The elevator car of claim 1, wherein the first engagement portion (22) is made of a plastics material or covered with a plastics material.

8. The elevator car of claim 1, wherein, in the retracted position, the at least one stabilizing member (14) is entirely within the vertical footprint of the working platform (12) and wherein, in the deployed position, the at least one stabilizing member (14) extends laterally outside of the vertical footprint of the working platform (12).

9. The elevator car of claim 1, wherein the at least one stabilizing member (14) is lockable in the retracted position and/or is lockable in the deployed position.

10. The elevator car of claim 1, wherein the at least one stabilizing member (14) is a first stabilizing member (14*a*) and the working platform (12) further comprises a second stabilizing member (14*b*), and wherein the first stabilizing member (14*a*) and the second stabilizing member (14*b*) are positioned at opposed sides of the working platform (12).

11. An elevator system comprising an elevator car according to claim 1.

* * * * *